US006446277B1

(12) United States Patent
Blomet

(10) Patent No.: US 6,446,277 B1
(45) Date of Patent: Sep. 10, 2002

(54) HIGH-CAPACITY METHOD AND SYSTEM OF CHEMICAL AND/OR RADIOLOGICAL DECONTAMINATION

(75) Inventor: Joël Blomet, Valmondois (FR)

(73) Assignee: Prevor International, Paris (FR)

( * ) Notice: Subject to any disclaimer, the term of this patent is extended or adjusted under 35 U.S.C. 154(b) by 0 days.

(21) Appl. No.: 09/589,119

(22) Filed: Jun. 8, 2000

(30) Foreign Application Priority Data

Jun. 9, 1999 (FR) ..... 99 07266

(51) Int. Cl.[7] ..... A47K 3/022

(52) U.S. Cl. ..... 4/596; 4/597; 4/602; 4/625; 4/900

(58) Field of Search ..... 4/516, 597, 601–603, 4/620, 625, 626, 900; 134/111

(56) References Cited

U.S. PATENT DOCUMENTS 3,047,434 A * 7/1962 Bulat
4,348,777 A * 9/1982 Peterson ..... 4/596
4,796,311 A 1/1989 Shankman
4,800,597 A * 1/1989 Healey ..... 4/900
4,850,380 A 7/1989 Koslow
4,858,256 A * 8/1989 Shankman ..... 4/597
5,577,522 A * 11/1996 Barkley et al. ..... 134/111
5,666,984 A 9/1997 Horikawa et al.

FOREIGN PATENT DOCUMENTS

| | | |
|---|---|---|
| EP | 0 799 612 A2 | 8/1997 |
| FR | 2 583 035 | 12/1986 |
| JP | 53065310 | 10/1978 |

* cited by examiner

*Primary Examiner*—Charles R. Eloshway
(74) *Attorney, Agent, or Firm*—Larson & Taylor PLC

(57) ABSTRACT

A high-capacity chemical and/or radiological decontamination system including: a shower unit (1) designed to shower persons individually with a regeneratable active product for a predetermined time ranging between 5 and 20 seconds; a collecting device (14) for collecting the contaminated active product from the shower unit; and a unit (2) for regenerating the contaminated active product so that it can be recycled.

22 Claims, 2 Drawing Sheets

HIGH-CAPACITY METHOD AND SYSTEM OF CHEMICAL AND/OR RADIOLOGICAL DECONTAMINATION

BACKGROUND OF THE INVENTION

The present invention relates to improvements intended to provide a high-capacity chemical and/or radiological decontamination system, i.e. a system capable of processing at least a hundred people, possibly even several hundred people per hour.

A known approach to decontaminating persons exposed to chemicals or radiation is vigorous showering with a view to driving out contaminants present in the skin.

If a very large number of persons are contaminated simultaneously (military attack, terrorist attack, accident) special decontamination units are used to treat the people contaminated one after the other.

However, these known decontamination units, all of which are based on standard military models, have serious shortcomings which significantly limit their effectiveness.

The main drawback resides in the fact that water or soapy water is used for the decontaminating shower, dispensed from a shower head or in some cases by atomisers or misters. Water is capable of producing a low level of decontamination only and a large quantity of water needs to flow over the body of a contaminated person to completely remove the contaminating substances; if a first shower is not enough to eliminate the contamination completely, the person has to take a second shower, which delays the treatment of other persons waiting.

In practice, in order to treat a person effectively, a 5 minute shower under water is necessary, which is an extremely long time when several hundred people need to be treated as quickly as possible.

Furthermore, in certain situations, supplying the large quantity of water needed to treat several hundred or even several thousand people may be problematic.

Another crucial problem is that of storage and possibly disposing of and treating the contaminated water after showering.

In addition to the problems inherent in choosing which product to use for decontamination purposes, there are also procedural problems to contend with. Before being sent into the shower, the contaminated persons have to be undressed (any clothing and other objects being removed by another route) and then re-clothed after showering. The time taken to undress will vary considerably depending on the condition of the person: on average, it will take a conscious, fully able person some 30 seconds but can require up to 6 minutes in the case of an elderly person or someone who is incapacitated or injured. Moreover, a prolonged wait before getting to the showers can generate waves of panic and/or give rise to secondary effects which will aggravate the condition of the people involved (for example, in the case of an attack outside in sunny weather).

Finally, in order to use these known decontamination units, it is necessary to determine the agent of aggression (chemical contamination or not, radio-nuclear contamination or not, . . . ), which further delays the start of the decontamination operation or runs the risk of errors.

The currently known decontamination units have the practical capacity to treat a total of 12 to 20 persons per hour, which is meaningless when groups of several hundred or even several thousand people have been contaminated simultaneously and need to be decontaminated as quickly as possible (the efficiency of the treatment depends to a large extent on the speed with which action can be taken).

SUMMARY OF THE INVENTION

It is against the background of these circumstances that the invention proposes an improved method and system which is intended to overcome the shortcomings of currently known systems and which will enable decontamination on a large scale, i.e. will be capable of treating at least a hundred people, possibly even several hundred people per hour.

To this end, a first aspect proposed by the invention is a high-capacity process of chemical and/or radiological decontamination characterised in that it incorporates the following steps which consist in:

- showering the contaminated persons individually with a regeneratable active product for a predetermined period ranging between 5 and 20 seconds,
- continuously collecting the used shower liquid and
- regenerating the collected liquid to restore its active capacity with a view to recycling.

By preference, the shower product used is a regeneratable active product which is amphoteric and has a chelating effect such as the product sold under the name of DIPHOTERINE, or derivatives thereof.

The advantage of using a product of this type is that it produces a decontaminating action much more quickly than water since a shower lasting for a few seconds, in practice about ten seconds, has proved to be sufficiently effective. The individual treatment of the affected persons is therefore speeded up by a ratio of 1 to 30 which, intrinsically speaking, is sufficient to make the method proposed by the invention a high-capacity procedure compared with the solutions currently used.

In addition, because it is regenerative in nature, there is no need to keep a very large stock of the shower product used for the method proposed by the invention. The product merely needs to be available in a sufficient quantity to meet a usage requirement of several tens of litres per minute, for example from 10 to 100 l/min, preferably in the order of 20 l/min. Circulating the product in a closed circuit, collecting the contaminated liquid after showering and regenerating it with a view to recycling solves both the problem of supplying a showering liquid and the problem of recovering the contaminated liquid. Once installed, the decontamination unit will therefore be able to operate for an unlimited period of time and without any constraints as to the number of persons who can be treated. It might even be conceivable to operate showers continuously as there would be no wastage at all, given that the shower product can be recuperated, and operation of the showers would be simplified (eliminating an automated on and off system); this could also help to speed up the process of getting people under the shower.

Finally, the amphoteric nature of the shower product used by preference makes this product universally applicable which will ensure effective decontamination irrespective of the nature of the contamination. It also avoids the risk of any errors of the type which can occur with the currently used systems and at the same time will considerably speed up the process of getting the decontamination unit up and running.

Using a product with chelating properties for showering enables the contaminated product to be regenerated when placed in contact with the same product which is not contaminated. Not only can the product be used in a closed circuit, the quantity of product used in such a closed loop can be kept relatively low and will only need to be topped with a small quantity of fresh product at certain times when contamination has reached a high level. In a preferred approach to implementing the method:

the liquid for each shower is drawn off from a tank, the spent shower liquid is collected and returned to said tank, the liquid contained in the tank is continuously agitated, the level of contamination of the liquid contained in the tank is continuously measured and the fresh active product introduced into the tank is adjusted to said measurement so that the liquid contained therein is fully and continuously regenerated.

In addition, by virtue of another aspect, the invention proposes a high-capacity chemical and/or radiological decontamination system capable of operating the method described above and which, in order to do so, is characterised in that it comprises:

a shower unit designed for showering persons individually with a regeneratable active product for a predetermined period ranging between 5 and 20 seconds, means for recovering the contaminated active product from each shower unit and a unit for regenerating the contaminated active product so that it can be recycled.

In view of the advantages explained above, the regeneratable active product used in the system described above will preferably be amphoteric and have chelating properties. Accordingly, due to the specific active nature of the product and its capacity to be regenerated rapidly, the time needed to shower individual persons can be reduced (5 to 20 seconds) and in practice a duration of some 10 seconds has been found to be sufficient. The length of showering can be automated to this timing, either by providing means (cells for example) to control activation and de-activation of the shower when a person walks into the shower and out of it respectively or, much more simply, by leaving the shower in continuous operation, which will not be a major drawback since the shower product is recovered, regenerated and recycled.

Another interesting feature is the fact that the product regeneration unit is also automated and comprises:

a tank containing the regeneratable active product, means to link the means used to collect contaminated active product and the tank in order to return the contaminated active product to the latter, agitation means designed to keep the product contained in the tank under constant agitation, means for measuring the level of contamination of the active product contained in the tank, a stock of fresh active product, and delivery means placed under the control of said measuring means to control the delivery of fresh product to the tank in a quantity sufficient to regenerate fully all the active product contained in the tank.

By preference, the installation will incorporate means for sterilising the active product delivered to the shower unit and/or means for filtering radioactive elements will be provided downstream of the recovery means for the contaminated active product.

In a preferred embodiment, the system comprises:

a shower unit having at least two shower cubicles disposed in a central position, at least one undressing unit comprising a plurality of individual undressing cubicles for contaminated persons and disposed on the entrance side of the shower unit, at least one intake filtering station at the entrance arranged between the undressing unit and the shower unit so as to direct each undressed contaminated person selectively at the appropriate time to a free shower unit, at least one dressing unit comprising a plurality of individual dressing cubicles for the showered persons located on the exit side of the shower unit, opposite the undressing unit and at least one exit filtering station arranged between the shower unit and the dressing unit so as to direct each showered person selectively to a free dressing cubicle.

Advantageously, a decontamination station is operated for each shower cubicle to deal with the papers and personal belongings of the showered persons.

Also advantageously, the undressing unit at one end and the dressing unit at the other end are arranged so that they substantially surround the centrally positioned shower unit such that all the undressing cubicles on one side and all the dressing cubicles on the other side are located more or less at a same distance from the shower unit; accordingly, the undressing cubicles at one end and the dressing cubicles at the other end are divided into several groups of cubicles aligned side by side in a desirable layout, these groups being laid out in a broken concave line around the shower unit.

Furthermore, with a view to increasing the speed and efficiency of the treatment, it is desirable for each shower cubicle to be of the type having a plurality of jets distributed on several posts surrounding the person being showered, such a shower station optionally being of the type described in document FR 2 513 871.

This system layout offers the best possible way of making use of the advantages gained by using active products that are amphoteric and have a chelating action, enabling a large number of contaminated persons to be treated (for example 100 to 200 persons per hour) using simple equipment that can be easily and rapidly installed at a relatively low cost.

BRIEF DESCRIPTION OF THE DRAWINGS

The invention will be more readily understood from the detailed description of certain embodiments below, given by way of illustration only and not restrictive in any respect. Throughout this description, reference will be made to the appended drawings, of which.

DETAILED DESCRIPTION OF THE INVENTION

Figure 1:
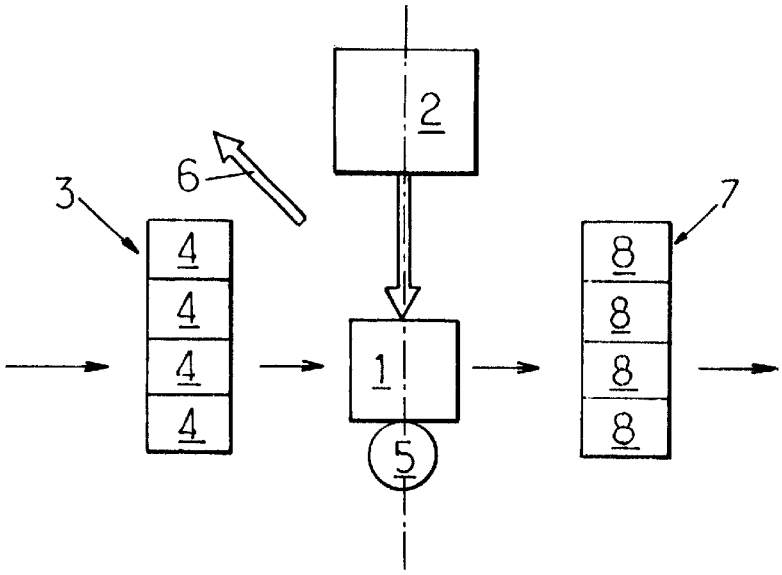
FIG. 1 is a very schematic and simplified illustration of a decontamination system laid out as proposed by the invention to operate the method proposed by the invention.

Turning firstly to FIG. 1, the decontamination system comprises, centrally positioned, a shower unit 1 designed to shower contaminated persons individually, for a time of between 5 and 20 seconds, with a regeneratable active product delivered by a regeneration unit 2.

The contaminated persons are received in an undressing unit 3, located to one side of the shower unit 1, comprising a plurality of undressing cubicles 4 to guarantee a continuous throughput of persons through the shower unit 1, taking account of the extremely variable time needed to undress depending on the state of the person (conscious or traumatised and/or injured persons, able-bodied or injured persons, young or elderly persons, . . . ).

An auxiliary decontamination unit 5 can be operated alongside the shower unit 1 to deal with personal items (papers, jewellery, . . . ). Personal effects removed from the persons will be taken away via the rear, however (arrow 6).

Having showered and the decontamination having been checked, the decontaminated persons leave the shower unit 1 at the opposite side from the entrance and enter a dressing unit 7 made up of a plurality of dressing cubicles 8 in the same way and for the same reasons as those obtaining in respect of the undressing unit 3.

The regeneratable active product used is preferably an amphoteric product with a chelating effect, particularly one such as the commercially known physiological solution sold under the name of DIPHOTERINE, or one of its derivatives.

As explained above, the amphoteric nature of the product used means that the system can be used universally regardless of the type of contamination and without the need to carry out tests and controls or to provide preliminary facilities. The system can therefore be made ready for use very rapidly.

The chelating properties of the product also mean that a simple and rapid regeneration process can be set up without the need for an auxiliary reprocessing unit or any delay in re-circulating the product. The system is operated in a closed circuit with a minimum top-up of fresh product, making the system autonomous.

Figure 2:
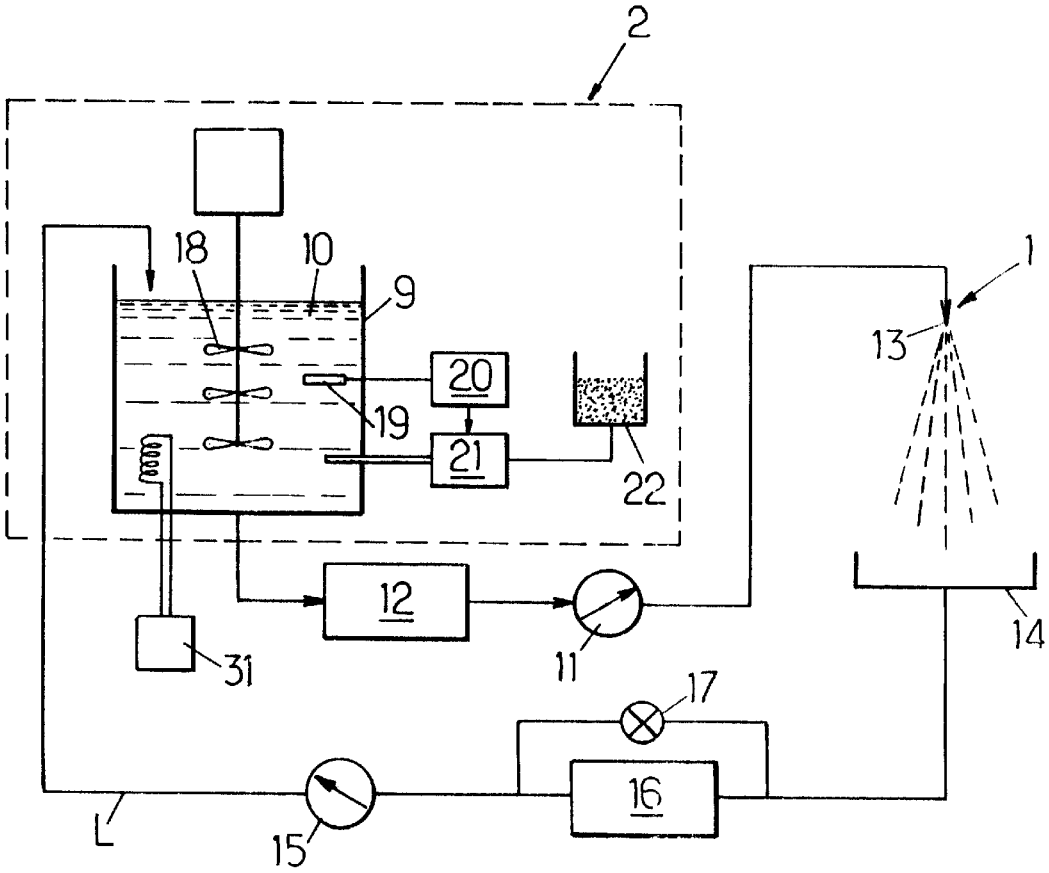
FIG. 2 is a diagram of the regeneration unit incorporated in the system illustrated in FIG. 1.

Turning to FIG. 2, the regeneration unit 2 comprises a tank 9 containing from 100 to 1000 liters of a liquid solution 10 of the active product. At the output of the tank, the liquid 10, propelled by a pump 11, is preferably sterilised: this sterilisation may take place either upstream of the tank or downstream thereof (at 12 in FIG. 1) before being delivered to a shower cubicle 13 in the shower unit 1.

To ensure that the showering process runs smoothly irrespective of the state of the person to be decontaminated, it is desirable for the shower to operate without any manual intervention. Operation may therefore be automated (switched on and off by a cell (s) as the person arrives and leaves) or may be continuous.

The contaminated liquid is continuously recovered in collection means, for example a base 14, from where it is picked up by a pump 15. A filter or trap for radioactive elements 16 may be provided in the evacuation circuit L for the contaminated liquid, selectively operated in the event of radiological contamination or switched off (short-circuit 17) in the event of other types of contamination.

The contaminated liquid collected is returned to the tank 9 where it is mixed (agitation 18) in the active solution 10. The chelating properties of the product used regenerate the contaminated liquid in contact with the non-contaminated liquid in the tank. To make sure that regeneration takes place as rapidly as possible even if there is a sudden increase in the quantity of contaminated liquid, a sensor 19 is provided in the body of liquid and the contamination level is continuously measured at 20. The measuring device 20 is placed under the control of a delivery device 21 which is programmed to deliver an appropriate volume of active product to the tank 9 (for example a concentrate of the product in powdered or granular form) drawn off from a stock 22.

It should be pointed out that the quantity of extra product added remains low: in the case of the physiological solution mentioned above, a top-up quantity of only about 1.8 kg of fresh product (concentrated powder) is needed for 200 persons.

If necessary, the liquid product can be heated (31) in the tank 9.

Figure 3:
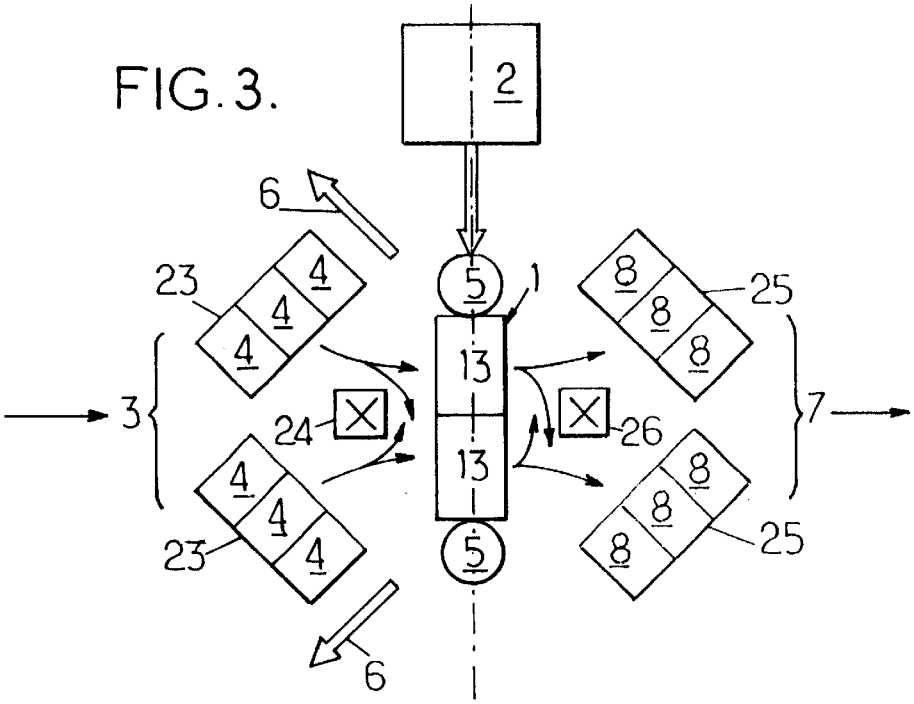
FIG. 3 is a very schematic view of a preferred embodiment of a system as proposed by the unit.

To ensure that the highest number of people are treated as quickly as possible and to avoid any interruption of the flow of people being treated in the event of an incident, it is desirable to use a system of the type illustrated in FIG. 3.

The shower unit 1 comprises at least two shower cubicles 13 so that the operating continuity of the shower unit can be assured even if one of the shower cubicles should temporarily be placed out of operation (breakdown, person fainting, . . . ). All the shower cubicles 13 are individually supplied with liquid from a single regenerating unit 2 and the effluent from these shower cubicles is collected and returned to the same tank 9 of the unit 2.

The undressing cubicles 4 of the undressing station 3 are split up into several groups 23: each group 23 comprises several undressing cubicles 4 aligned side by side and the groups 23 are arranged in a concave broken line at the side of the shower unit 1 so that all the shower cubicles are located more or less at a same distance from the shower unit 1. In the free space between the undressing unit 3 and the shower unit 1, it is desirable to provide an intake filter system 24, which might be manned by at least one person to control and regulate the throughput of each undressed contaminated person to a free shower cubicle.

The dressing unit 7 may be laid out in the same manner with the dressing cubicles 8 split up into groups 25 surrounding the shower unit 1 on the other side thereof and with an exit filter system 26 in an intermediate position to control the flow of decontaminated persons.

Figure 4:
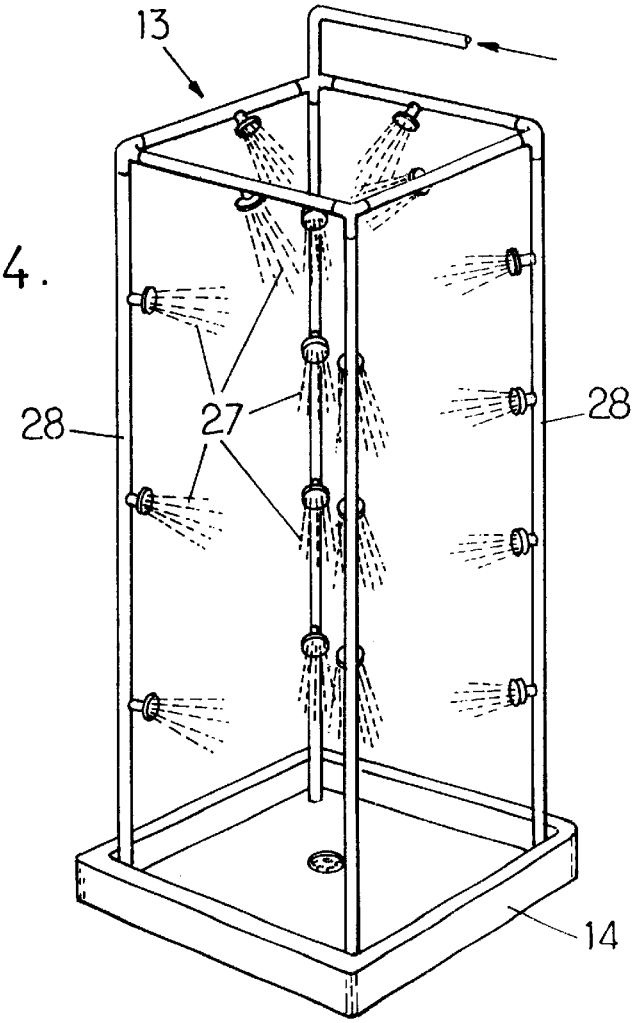
FIG. 4 is a simplified view of a shower cubicle used in a system proposed by the invention.

Each shower cubicle is preferably laid out in the form of an integral shower as illustrated in FIG. 4. In order to ensure that the entire body of the person being treated is showered fully and simultaneously, the shower cubicle 13 has a plurality of jet nozzles 27 distributed vertically on uprights 28, of which there are three or four distributed around the base 14, other nozzles 27 being arranged across the top on cross-members. Furthermore, the jets may be vertically offset from one another from one upright 28 to the next. A shower cubicle of this design is described in detail in document FR 2 513 871. A shower cubicle of this type may advantageously have from 20 to 30 nozzles, preferably around twenty.

It is desirable for each shower cubicle to be at least 0.60 m wide, preferably in the order of 1.20 m, with a depth of at least 0.60 m, preferably in the order of 0.80 m, to provide the capacity to receive obese persons or an adult holding a child in his/her arms.

The liquid may be sprayed either as fine jets or micronized (mist): the liquid flow rate is from 10 to 100 liters/minute, preferably on average about 20 liters/minute so that decontamination will be effected within 5 to 20 seconds, on average preferably 10 seconds during normal operation using the above-mentioned physiological solution.

What is claimed is:

1. A high-capacity, chemical and/or radiological decontamination system, comprising;

a shower unit designed to shower persons individually with an active product whereby a used active product is produced, wherein said shower unit has at least two shower cubicles disposed in a central position, at least one undressing unit comprising a plurality of individual undressing cubicles for contaminated persons and disposed on an entrance side to the shower unit, at least one intake filtering station disposed between the at least one undressing unit and the shower unit to direct undressed contaminated persons selectively to a free shower cubicle, at least one dressing unit comprising a plurality of individual dressing cubicles for showered persons disposed on an exit side of the shower unit, opposite the at least one undressing unit, at least one exit filtering station disposed between the shower unit and the at least one dressing unit to direct each showered person selectively to a free dressing cubicle, and means for collecting the used active product from the shower unit.

2. A high-capacity, chemical and/or radiological decontamination system as claimed in claim 1:

wherein the active product is a regeneratable active product which is amphoteric and has chelating properties, wherein each person showers for a predetermined time ranging between 5 and 20 seconds, and a unit for regenerating the used active product so that it can be recycled.

3. A system as claimed in claim 2, wherein the time taken to shower each person individually is approximately 10 seconds.

4. A system as claimed claim 2, wherein the regeneration unit comprises:

a tank containing the regeneratable active product, connecting means between the means for collecting the used active product and the tank so that the used active product can be returned to the tank, agitation means for agitating the active product contained in the tank continuously, means for measuring a contamination level of the active product contained in the tank, a stock of fresh active product, and delivery means, under control of said measuring means, for controlling delivery of the fresh active product contained in the stock to the tank in a quantity sufficient to regenerate fully all the active product contained in the tank.

5. A system as claimed in claim 1, wherein means for sterilizing the active product delivered to the shower unit are provided.

6. A system as claimed in claim 1, further including means for filtering radioactive elements from the used active product collected by the means for collecting.

7. A system as claimed in claim 1, wherein a decontamination station for handling papers and personal belongings of showered persons is operated in conjunction with each shower cubicle.

8. A system as claimed in claim 1, wherein the at least one undressing unit on one side and the at least one dressing unit on the other side are laid out so that they essentially surround the shower unit which is centrally positioned therebetween such that all the undressing cubicles on one side and all the dressing cubicles on the other side are located more or less at a same distance from the shower unit.

9. A system as claimed in claim 1, wherein the at least one undressing unit on one side and the at least one dressing unit on the other side are laid out so that they essentially surround the shower unit which is centrally positioned therebetween such that all the undressing cubicles on one side and all the dressing cubicles on the other side are located more or less at a same distance from the shower unit and wherein the undressing cubicles on one side and the dressing cubicles on the other side are distributed in several groups of cubicles aligned side by side, these groups being laid out in a concave broken line around the shower unit.

10. A system as claimed in claim 1, wherein each shower cubicle has multiple jets distributed along several posts surrounding a showering location.

11. A high-capacity method of chemical and/or radiological decontamination, said method comprising the steps of:

constantly agitating a regeneratable active product in a tank;

individually showering contaminated persons with the regeneratable active product which is drawn off from the tank for a predetermined period ranging between 5 and 20 seconds whereby a used regeneratable active product is produced;

continuously collecting the used regeneratable active product;

regenerating the used regeneratable active product collected in order to restore an active property thereof;

returning the regenerated used active product to the tank;

continuously measuring a level of contamination of the regeneratable active product contained in the tank; and introducing into the tank a quantity of fresh active product adjusted to the measured level of contamination so that the regeneratable active product contained in the tank is totally and continuously regenerated.

12. A method as claimed in claim 11, wherein each shower takes approximately 10 seconds.

13. A method as claimed in claim 11, wherein the regeneratable active product is amphoteric and has chelating properties.

14. A high-capacity, chemical and/or radiological decontamination system, comprising:

a tank containing a regeneratable active product;

a shower unit designed to shower persons individually with the regeneratable active product from the tank for a predetermined time ranging between 5 and 20 seconds whereby a used active product is produced;

collecting means for collecting the used active product from a shower unit;

connecting means between the collecting means and the tank so that the used active product can be returned to the tank;

a regenerating means for regenerating the used active product so that it can be recycled, said regenerating means including agitation means for agitating the active product contained in the tank continuously;

a measuring means for measuring a contamination level of the active product contained in the tank;

a stock of fresh active product; and a delivery means, under control of said measuring means, for controlling deliver of the fresh active product contained in the stock to the tank in a quantity sufficient to regenerate fully all the active product contained in the tank.

15. A system as claimed in claim 14, wherein the regeneratable active product is amphoteric and has chelating properties.

16. A system as claimed in claim 14, wherein means for sterilizing the active product delivered to the shower unit are provided.

17. A system as claimed in claim 14, further including means for filtering radioactive elements from the used active product collected by the means for collecting.

18. A system as claimed in claim 14, further comprising:

a shower unit with at least two shower cubicles disposed in a central position, at least one undressing unit comprising a plurality of individual undressing cubicles for contaminated persons and disposed on the entrance side to the shower unit, at least one intake filtering station disposed between the at least one undressing unit and the shower unit to direct undressed contaminated persons selectively to a free shower cubicle, at least one dressing unit comprising a plurality of individual dressing cubicles for showered persons disposed on the exit side of the shower unit, opposite the at least one undressing unit, and at least one exit filtering station disposed between the shower unit and the at least one dressing unit to direct each showered person selectively to a free dressing cubicle.

19. A system as claimed in claim 18, wherein a decontamination station for handling papers and personal belongings of showered persons is operated in conjunction with each shower cubicle.

20. A system as claimed in claim 18, wherein the at least one undressing unit on one side and the at least one dressing unit on the other side are laid out so that they essentially surround the shower unit which is centrally positioned therebetween such that all the undressing cubicles on one side and all the dressing cubicles on the other side are located more or less at a same distance from the shower unit.

21. A system as claimed in claim 18, wherein the at least one undressing unit on one side and the at least one dressing unit on the other side are laid out so that they essentially surround the shower unit which is centrally positioned therebetween such that all the undressing cubicles on one side and all the dressing cubicles on the other side are located more or less at a same distance from the shower unit and wherein the undressing cubicles on one side and the dressing cubicles on the other side are distributed in several groups of cubicles aligned side by side, these groups being laid out in a concave broken line around the shower unit.

22. A system as claimed in claim 18, wherein each shower cubicle has multiple jets distributed along several posts surrounding a showering location.

* * * * *